US008483916B2

(12) United States Patent
Peterson et al.

(10) Patent No.: US 8,483,916 B2
(45) Date of Patent: Jul. 9, 2013

(54) HYDRAULIC CONTROL SYSTEM IMPLEMENTING PUMP TORQUE LIMITING

(75) Inventors: Grant S. Peterson, Metamora, IL (US); Randall T. Anderson, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 216 days.

(21) Appl. No.: 13/037,084

(22) Filed: Feb. 28, 2011

(65) Prior Publication Data

US 2012/0221212 A1 Aug. 30, 2012

(51) Int. Cl.
*G06G 7/70* (2006.01)

(52) U.S. Cl.
USPC ..... 701/50

(58) Field of Classification Search
USPC ..... 701/50
See application file for complete search history.

(56) References Cited

U.S. PATENT DOCUMENTS

| | | | | |
|---|---|---|---|---|
| 4,335,577 | A | 6/1982 | Lobmeyer et al. | |
| 4,712,376 | A | 12/1987 | Hadank et al. | |
| 5,056,312 | A | 10/1991 | Hirata et al. | |
| 5,155,996 | A | 10/1992 | Tatsumi et al. | |
| 5,832,805 | A | 11/1998 | Kurashima et al. | |
| 5,873,245 | A * | 2/1999 | Kato et al. | 60/445 |
| 5,950,429 | A * | 9/1999 | Hamkins | 60/422 |
| 6,321,152 | B1 | 11/2001 | Amborski et al. | |
| 6,378,302 | B1 * | 4/2002 | Nozawa et al. | 60/422 |

(Continued)

FOREIGN PATENT DOCUMENTS

| | | |
|---|---|---|
| EP | 1338832 | 8/2003 |
| JP | 05248404 | 9/1993 |

OTHER PUBLICATIONS

Phanindra Garimella et al., "Fault Detection of an Electro-Hydraulic Cylinder Using Adaptive Robus Observers," IMECE2004-61718, 2004 ASME International Mechanical Engineering Congress and Exposition, Nov. 13-20, 2004.

(Continued)

*Primary Examiner* — Hussein A. Elchanti
(74) *Attorney, Agent, or Firm* — Finnegan, Henderson, Farabow, Garrett & Dunner LLP

(57) ABSTRACT

A hydraulic control system is disclosed. The hydraulic control system may have a pump, a plurality of actuators, and a plurality of valve arrangements configured to meter pressurized. The hydraulic control system may also have at least one operator input device configured to generate signals indicative of desired velocities of the plurality of actuators, and a controller. The controller may be configured to receive a pump torque limit, determine a maximum pump flow capacity, and determine desired flow rates for each of the plurality of valve arrangements based on the signals. The controller may also be configured to make a first reduction of the desired flow rates based on the maximum pump flow capacity, to make a second reduction of the desired flow rates based on the pump torque limit, and to command the plurality of valve arrangements to meter the desired flow rates after the second reduction.

20 Claims, 3 Drawing Sheets

U.S. PATENT DOCUMENTS

| | | | | |
|---|---|---|---|---|
| 6,438,952 | B1 * | 8/2002 | Nozawa et al. | 60/422 |
| 6,775,974 | B2 | 8/2004 | Tabor | |
| 6,845,702 | B2 * | 1/2005 | Sagawa et al. | 91/446 |
| 6,912,849 | B2 | 7/2005 | Inoue et al. | |
| 7,260,931 | B2 | 8/2007 | Egelja et al. | |
| 7,546,729 | B2 | 6/2009 | Palmer et al. | |
| 7,665,299 | B2 | 2/2010 | Schuh et al. | |
| 7,712,309 | B2 | 5/2010 | Vigholm | |
| 2002/0108486 | A1 | 8/2002 | Sannomiya et al. | |
| 2003/0019209 | A1 * | 1/2003 | Tsuruga et al. | 60/459 |
| 2003/0158646 | A1 | 8/2003 | Nishida et al. | |
| 2004/0040294 | A1 * | 3/2004 | Sagawa et al. | 60/452 |
| 2009/0293468 | A1 | 12/2009 | Kim | |
| 2010/0154403 | A1 | 6/2010 | Brickner et al. | |
| 2010/0229705 | A1 | 9/2010 | Christoforou et al. | |

OTHER PUBLICATIONS

U.S. Patent Application of Grant S. Peterson et al. entitled "Hydraulic Control System Having Cylinder Stall Strategy" filed on Feb. 28, 2011.

U.S. Patent Application of Grant S. Peterson et al. entitled "Hydraulic Control System Having Cylinder Flow Correction" filed on Feb. 28, 2011.

* cited by examiner

HYDRAULIC CONTROL SYSTEM IMPLEMENTING PUMP TORQUE LIMITING

TECHNICAL FIELD

The present disclosure relates generally to a hydraulic control system, and more particularly, to a hydraulic control system that implements a pump torque limiting operation.

BACKGROUND

Machines such as wheel loaders, excavators, dozers, motor graders, and other types of heavy equipment use multiple actuators supplied with hydraulic fluid from one or more pumps on the machine to accomplish a variety of tasks. These actuators are typically velocity controlled based on, among other things, an actuation position of an operator interface device. In particular, when an operator moves a particular interface device to a specific displaced position, the operator expects a corresponding hydraulic actuator to move at a predetermined velocity in a desired direction. During operation, however, it may be possible for the operator to request multiple actuators to move at velocities that together cause the supply pump to exceed a torque limit and/or a power output of the engine driving the pump. If left unchecked, it may be possible for the operator to request velocities that cause the engine to stall and/or operate inefficiently.

One attempt to reduce the likelihood of engine stall caused by operation of a machine's hydraulic system is disclosed in U.S. Patent Publication 2010/0154403 of Brickner et al. that published on Jan. 24, 2010 (the '403 publication). In particular, the '403 publication describes a hydraulic system having a variable displacement pump driven by an engine to supply pressurized fluid through a plurality of valves to a corresponding plurality of actuators, and a controller in communication with a manual control device and the valves. The controller is configured to receive from the manual control device desired velocities for each of the actuators, and from the engine a pump torque limit. The controller is further configured to determine flow rates for the actuators corresponding to the desired velocities, and a flow limit based on the pump torque limit. The controller is then configured to calculate a reduction ratio equal to the pump torque flow limit divided by the sum of the desired flow rates, and then apply that ratio to each of the determined flow rates before corresponding commands are directed to each of the valves. The reduced ratios help to ensure that the commanded flow rates together will not demand a pump torque greater than the torque limit required by the engine.

Although the system of the '403 publication may help to reduce the likelihood of engine stall, it may be less than optimal. In particular, the system of the '403 publication may not consider other factors affecting valve flow and pump torque such as pump flow capacity, actuator stall, flow correction, or gravity assistance.

The disclosed hydraulic control system is directed to overcoming one or more of the problems set forth above and/or other problems of the prior art.

SUMMARY

In one aspect, the present disclosure is directed to a hydraulic control system. The hydraulic control system may include a pump configured to pressurize fluid, a plurality of actuators configured to receive the pressurized fluid, and a plurality of valve arrangements configured to meter pressurized fluid from the pump into the plurality of actuators. The hydraulic control system may also have at least one operator input device configured to generate signals indicative of desired velocities of the plurality of actuators, and a controller in communication with the plurality of valves and the at least one operator input device. The controller may be configured to receive a pump torque limit, determine a maximum pump flow capacity, and determine desired flow rates for each of the plurality of valve arrangements based on the signals from the at least one operator input device. The controller may also be configured to make a first reduction of the desired flow rates based on the maximum pump flow capacity, to make a second reduction of the desired flow rates based on the pump torque limit, and to command the plurality of valve arrangements to meter the desired flow rates after the second reduction.

In another aspect, the present disclosure is directed to a method of operating a machine. The method may include pressurizing fluid, receiving a torque limit associated with the pressurizing, and determining a maximum flow rate capacity associated with the pressurizing. The method may further include receiving operator input indicative of desired velocities for a plurality of hydraulic actuators, and determining desired flow rates of fluid for each of the plurality of hydraulic actuators based on the desired velocities. The method may additionally include making a first reduction of the desired flow rates based on the maximum flow rate capacity, making a second reduction of the desired flow rates based on the torque limit, and metering the pressurized fluid into the plurality of hydraulic actuators after the second reduction.

DETAILED DESCRIPTION

Figure 1:
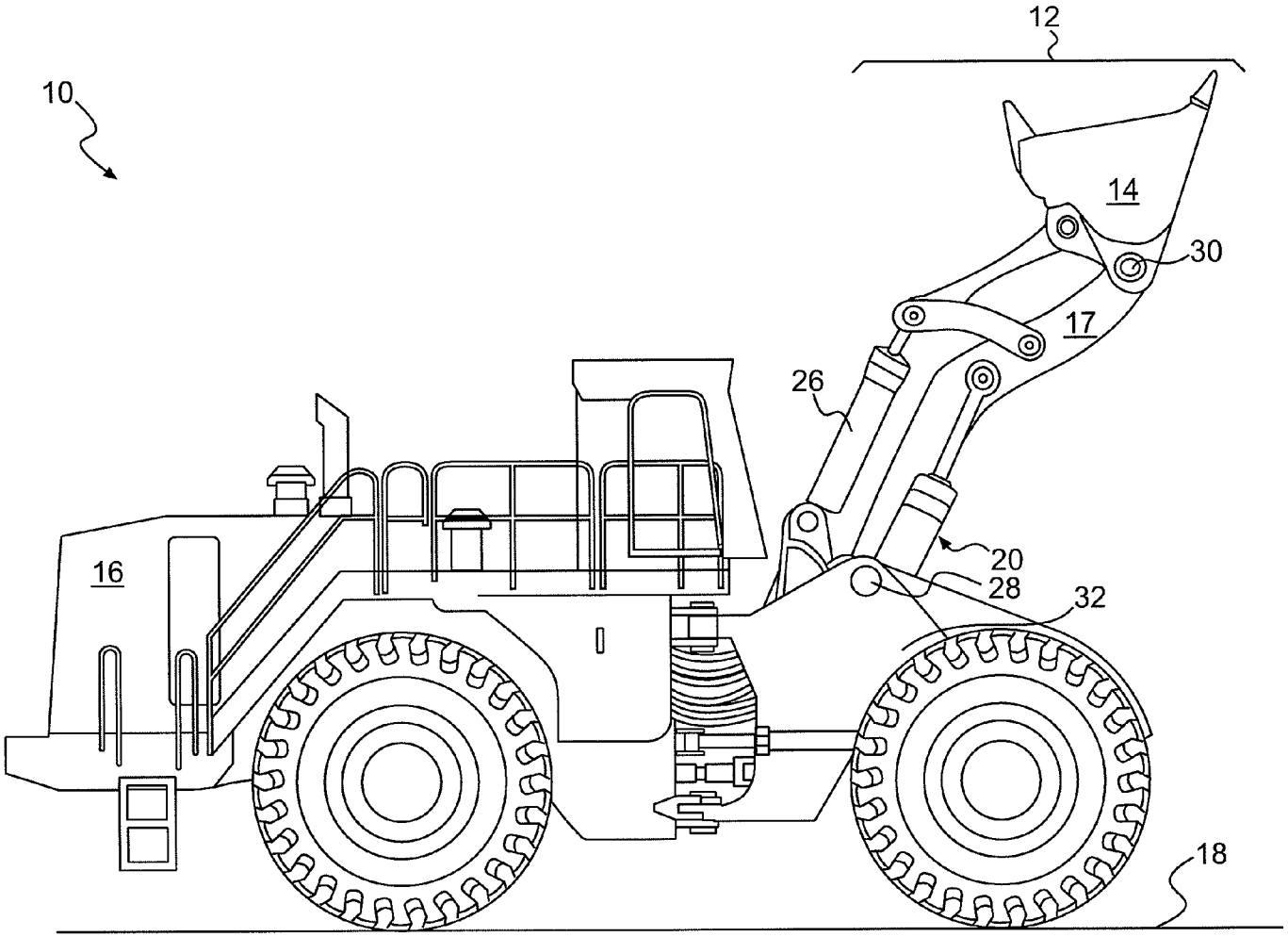
FIG. 1 is a side-view diagrammatic illustration of an exemplary disclosed machine.

FIG. 1 illustrates an exemplary machine 10 having multiple systems and components that cooperate to accomplish a task. Machine 10 may embody a fixed or mobile machine that performs some type of operation associated with an industry such as mining, construction, farming, transportation, or another industry known in the art. For example, machine 10 may be a material moving machine such as the loader depicted in FIG. 1. Alternatively, machine 10 could embody an excavator, a dozer, a backhoe, a motor grader, a dump truck, or another similar machine. Machine 10 may include, among other things, a linkage system 12 configured to move a work tool 14, and a prime mover 16 that provides power to linkage system 12.

Linkage system 12 may include structure acted on by fluid actuators to move work tool 14. Specifically, linkage system 12 may include a boom (i.e., a lifting member) 17 that is vertically pivotable about a horizontal axis 28 relative to a work surface 18 by a pair of adjacent, double-acting, hydraulic cylinders 20 (only one shown in FIG. 1). Linkage system 12 may also include a single, double-acting, hydraulic cylinder 26 connected to tilt work tool 14 relative to boom 17 in a vertical direction about a horizontal axis 30. Boom 17 may be pivotably connected at one end to a body 32 of machine 10, while work tool 14 may be pivotably connected to an opposing end of boom 17. It should be noted that alternative linkage configurations may also be possible.

Numerous different work tools 14 may be attachable to a single machine 10 and controlled to perform a particular task. For example, work tool 14 could embody a bucket (shown in FIG. 1), a fork arrangement, a blade, a shovel, a ripper, a dump bed, a broom, a snow blower, a propelling device, a cutting device, a grasping device, or another task-performing device known in the art. Although connected in the embodiment of FIG. 1 to lift and tilt relative to machine 10, work tool 14 may alternatively or additionally pivot, rotate, slide, swing, or move in any other appropriate manner.

Prime mover 16 may embody an engine such as, for example, a diesel engine, a gasoline engine, a gaseous fuel-powered engine, or another type of combustion engine known in the art that is supported by body 32 of machine 10 and operable to power the movements of machine 10 and work tool 14. It is contemplated that prime mover may alternatively embody a non-combustion source of power, if desired, such as a fuel cell, a power storage device (e.g., a battery), or another source known in the art. Prime mover 16 may produce a mechanical or electrical power output that may then be converted to hydraulic power for moving hydraulic cylinders 20 and 26.

Prime mover 16 may have a limited amount of power that may be directed for use by hydraulic cylinders 20, 26. When more power is consumed than prime mover 16 can continuously supply, prime mover 16 could experience a stall condition, causing a droop in output speed and efficiency. In some situations, prime mover 16 may even stop functioning altogether during the stall condition. Accordingly, prime mover 16 may be configured to establish a maximum torque limit that hydraulic cylinders 20, 26 are allowed to consume without causing prime mover 16 to experience the stall condition.

Figure 2:
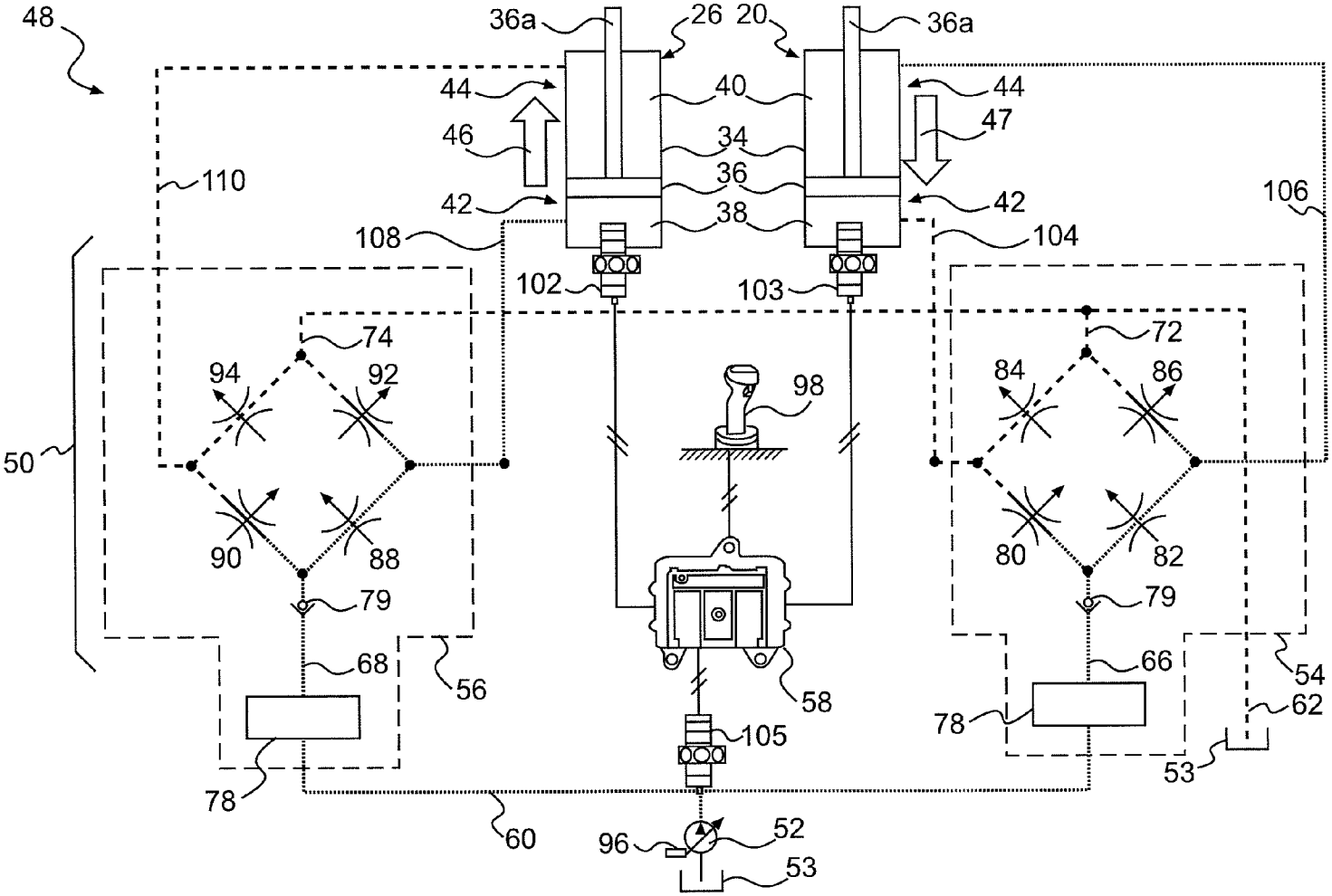
FIG. 2 is a schematic illustration of an exemplary disclosed hydraulic control system that may be used in conjunction with the machine of FIG. 1.

For purposes of simplicity, FIG. 2 illustrates the composition and connections of only hydraulic cylinder 26 and one of hydraulic cylinders 20. It should be noted, however, that machine 10 may include other hydraulic actuators connected to move the same or other structural members of linkage system 12 in a similar manner, if desired.

As shown in FIG. 2, each of hydraulic cylinders 20 and 26 may include a tube 34 and a piston assembly 36 arranged within tube 34 to form a first chamber 38 and a second chamber 40. In one example, a rod portion 36*a* of piston assembly 36 may extend through an end of second chamber 40. As such, second chamber 40 may be associated with a rod-end 44 of its respective cylinder, while first chamber 38 may be associated with an opposing head-end 42 of its respective cylinder.

First and second chambers 38, 40 may each be selectively supplied with pressurized fluid and drained of the pressurized fluid to cause piston assembly 36 to displace within tube 34, thereby changing an effective length of hydraulic cylinders 20, 26 and moving work tool 14 (referring to FIG. 1). A flow rate of fluid into and out of first and second chambers 38, 40 may relate to a velocity of hydraulic cylinders 20, 26 and work took 14, while a pressure differential between first and second chambers 38, 40 may relate to a force imparted by hydraulic cylinders 20, 26 on work tool 14. An expansion (represented by an arrow 46) and a retraction (represented by an arrow 47) of hydraulic cylinders 20, 26 may function to assist in moving work tool 14 in different manners (e.g., lifting and tilting work tool 14, respectively).

To help regulate filling and draining of first and second chambers 38, 40, machine 10 may include a hydraulic control system 48 having a plurality of interconnecting and cooperating fluid components. Hydraulic control system 48 may include, among other things, a valve stack 50 at least partially forming a circuit between hydraulic cylinders 20, 26, an engine-driven pump 52, and a tank 53. Valve stack 50 may include a lift valve arrangement 54, a tilt valve arrangement 56, and, in some embodiments, one or more auxiliary valve arrangements (not shown) that are fluidly connected to receive and discharge pressurized fluid in parallel fashion. In one example, valve arrangements 54, 56 may include separate bodies bolted to each other to form valve stack 50. In another embodiment, each of valve arrangements 54, 56 may be stand-alone arrangements, connected to each other only by way of external fluid conduits (not shown). It is contemplated that a greater number, a lesser number, or a different configuration of valve arrangements may be included within valve stack 50, if desired. For example, a swing valve arrangement (not shown) configured to control a swinging motion of linkage system 12, one or more travel valve arrangements, and other suitable valve arrangements may be included within valve stack 50. Hydraulic control system 48 may further include a controller 58 in communication with prime mover 16 and with valve arrangements 54, 56 to control corresponding movements of hydraulic cylinders 20, 26 within the torque limit established by prime mover 16.

Each of lift and tilt valve arrangements 54, 56 may regulate the motion of their associated fluid actuators. Specifically, lift valve arrangement 54 may have elements movable to simultaneously control the motions of both of hydraulic cylinders 20 and thereby lift boom 17 relative to work surface 18. Likewise, tilt valve arrangement 56 may have elements movable to control the motion of hydraulic cylinder 26 and thereby tilt work tool 14 relative to boom 17. During a lowering movement of boom 17 and a downward tilting movement of work tool 14, hydraulic cylinders 20, 26 may be assisted by the force of gravity. In contrast, during upward lifting and tilting movements, hydraulic cylinders 20, 26 may be working against the force of gravity. During the gravity-assisted movement, hydraulic cylinders 20, 26 may be capable of operating in a regeneration mode, wherein pressurized fluid (i.e., regeneration fluid) from one of first and second chambers 38, 40 may be discharged at a high enough pressure for immediate reuse within the other of first and second chambers 38, 40, thereby reducing a load on hydraulic control system 48.

Valve arrangements 54, 56 may be connected to regulate flows of pressurized fluid to and from hydraulic cylinders 20, 26 via common passages. Specifically, valve arrangements 54, 56 may be connected to pump 52 by way of a common supply passage 60, and to tank 53 by way of a common drain passage 62. Lift and tilt valve arrangements 54, 56 may be connected in parallel to common supply passage 60 by way of individual fluid passages 66 and 68, respectively, and in parallel to common drain passage 62 by way of individual fluid passages 72 and 74, respectively. A pressure compensating valve 78 and/or a check valve 79 may be disposed within each of fluid passages 66, 68 to provide a unidirectional supply of fluid having a substantially constant flow to valve arrangements 54, 56. Pressure compensating valves 78 may be pre-(shown in FIG. 2) or post-compensating (not shown) valves movable, in response to a differential pressure, between a flow passing position and a flow blocking position such that a substantially constant flow of fluid is provided to valve arrangements 54 and 56, even when a pressure of the fluid directed to pressure compensating valves 78 varies. It is contemplated that, in some applications, pressure compensating valves 78 and/or check valves 79 may be omitted, if desired.

Each of lift and tilt valve arrangements 54, 56 may be substantially identical and include four independent metering valves (IMVs). Of the four IMVs, two may be generally associated with fluid supply functions, while two may be generally associated with drain functions. For example, lift valve arrangement 54 may include a head-end supply valve 80, a rod-end supply valve 82, a head-end drain valve 84, and a rod-end drain valve 86. Similarly, tilt valve arrangement 56 may include a head-end supply valve 88, a rod-end supply valve 90, a head-end drain valve 92, and a rod-end drain valve 94.

Head-end supply valve 80 may be disposed between fluid passage 66 and a fluid passage 104 that leads to first chamber 38 of hydraulic cylinder 20, and be configured to regulate a flow rate of pressurized fluid into first chamber 38 in response to a flow command from controller 58. Head-end supply valve 80 may include a variable-position, spring-biased valve element, for example a poppet or spool element, that is solenoid actuated and configured to move to any position between a first end-position at which fluid is allowed to flow into first chamber 38, and a second end-position at which fluid flow is blocked from first chamber 38. It is contemplated that head-end supply valve 80 may also be configured to allow fluid from first chamber 38 to flow through head-end supply valve 80 during a regeneration event when a pressure within first chamber 38 exceeds a pressure of pump 52 and/or a pressure of the chamber receiving the regenerated fluid. It is further contemplated that head-end supply valve 80 may include additional or different elements than described above such as, for example, a fixed-position valve element or any other valve element known in the art. It is also contemplated that head-end supply valve 80 may alternatively be hydraulically actuated, mechanically actuated, pneumatically actuated, or actuated in another suitable manner.

Rod-end supply valve 82 may be disposed between fluid passage 66 and a fluid passage 106 leading to second chamber 40 of hydraulic cylinder 20, and be configured to regulate a flow rate of pressurized fluid into second chamber 40 in response to a flow command from controller 58. Rod-end supply valve 82 may include a variable-position, spring-biased valve element, for example a poppet or spool element, that is solenoid actuated and configured to move to any position between a first end-position at which fluid is allowed to flow into second chamber 40, and a second end-position at which fluid is blocked from second chamber 40. It is contemplated that rod-end supply valve 82 may also be configured to allow fluid from second chamber 40 to flow through rod-end supply valve 82 during a regeneration event when a pressure within second chamber 40 exceeds a pressure of pump 52 and/or a pressure of the chamber receiving the regenerated fluid. It is further contemplated that rod-end supply valve 82 may include additional or different valve elements such as, for example, a fixed-position valve element or any other valve element known in the art. It is also contemplated that rod-end supply valve 82 may alternatively be hydraulically actuated, mechanically actuated, pneumatically actuated, or actuated in another suitable manner.

Head-end drain valve 84 may be disposed between fluid passage 104 and fluid passage 72, and be configured to regulate a flow rate of pressurized fluid from first chamber 38 of hydraulic cylinder 20 to tank 53 in response to a flow command from controller 58. Head-end drain valve 84 may include a variable-position, spring-biased valve element, for example a poppet or spool element, that is solenoid actuated and configured to move to any position between a first end-position at which fluid is allowed to flow from first chamber 38, and a second end-position at which fluid is blocked from flowing from first chamber 38. It is contemplated that head-end drain valve 84 may include additional or different valve elements such as, for example, a fixed-position valve element or any other valve element known in the art. It is also contemplated that head-end drain valve 84 may alternatively be hydraulically actuated, mechanically actuated, pneumatically actuated, or actuated in another suitable manner.

Rod-end drain valve 86 may be disposed between fluid passage 106 and fluid passage 72, and be configured to regulate a flow rate of pressurized fluid from second chamber 40 of hydraulic cylinder 20 to tank 53 in response to a flow command from controller 58. Rod-end drain valve 86 may include a variable-position, spring-biased valve element, for example a poppet or spool element, that is solenoid actuated and configured to move to any position between a first end-position at which fluid is allowed to flow from second chamber 40, and a second end-position at which fluid is blocked from flowing from second chamber 40. It is contemplated that rod-end drain valve 86 may include additional or different valve elements such as, for example, a fixed-position valve element or any other valve element known in the art. It is also contemplated that rod-end drain valve 86 may alternatively be hydraulically actuated, mechanically actuated, pneumatically actuated, or actuated in another suitable manner.

Head-end supply valve 88 may be disposed between fluid passage 68 and a fluid passage 108 that leads to first chamber 38 of hydraulic cylinder 26, and be configured to regulate a flow rate of pressurized fluid into first chamber 38 in response to a flow command from controller 58. Head-end supply valve 88 may include a variable-position, spring-biased valve element, for example a poppet or spool element, that is solenoid actuated and configured to move to any position between a first end-position at which fluid is allowed to flow into first chamber 38, and a second end-position at which fluid flow is blocked from first chamber 38. It is contemplated that head-end supply valve 88 may be also configured to allow fluid from first chamber 38 to flow through head-end supply valve 88 during a regeneration event when a pressure within first chamber 38 exceeds a pressure of pump 52 and/or a pressure of the chamber receiving the regenerated fluid. It is further contemplated that head-end supply valve 88 may include additional or different elements such as, for example, a fixed-position valve element or any other valve element known in the art. It is also contemplated that head-end supply valve 88 may alternatively be hydraulically actuated, mechanically actuated, pneumatically actuated, or actuated in another suitable manner.

Rod-end supply valve 90 may be disposed between fluid passage 68 and a fluid passage 110 that leads to second chamber 40 of hydraulic cylinder 26, and be configured to regulate a flow rate of pressurized fluid into second chamber 40 in response to a flow command from controller 58. Specifically, rod-end supply valve 90 may include a variable-position, spring-biased valve element, for example a poppet or spool element, that is solenoid actuated and configured to move to any position between a first end-position, at which fluid is allowed to flow into second chamber 40, and a second end-position, at which fluid is blocked from second chamber 40. It is contemplated that rod-end supply valve 90 may also be configured to allow fluid from second chamber 40 to flow through rod-end supply valve 90 during a regeneration event when a pressure within second chamber 40 exceeds a pressure of pump 52 and/or a pressure of the chamber receiving the regenerated fluid. It is further contemplated that rod-end supply valve 90 may include additional or different valve elements such as, for example, a fixed-position valve element or any other valve element known in the art. It is also contemplated that rod-end supply valve 90 may alternatively be hydraulically actuated, mechanically actuated, pneumatically actuated, or actuated in another suitable manner.

Head-end drain valve 92 may be disposed between fluid passage 108 and fluid passage 74, and be configured to regulate a flow rate of pressurized fluid from first chamber 38 of hydraulic cylinder 26 to tank 53 in response to a flow command from controller 58. Specifically, head-end drain valve 92 may include a variable-position, spring-biased valve element, for example a poppet or spool element, that is solenoid actuated and configured to move to any position between a first end-position at which fluid is allowed to flow from first chamber 38, and a second end-position at which fluid is blocked from flowing from first chamber 38. It is contemplated that head-end drain valve 92 may include additional or different valve elements such as, for example, a fixed-position valve element or any other valve element known in the art. It is also contemplated that head-end drain valve 92 may alternatively be hydraulically actuated, mechanically actuated, pneumatically actuated, or actuated in another suitable manner.

Rod-end drain valve 94 may be disposed between fluid passage 110 and fluid passage 74, and be configured to regulate a flow rate of pressurized fluid from second chamber 40 of hydraulic cylinder 26 to tank 53 in response to a flow command from controller 58. Rod-end drain valve 94 may include a variable-position, spring-biased valve element, for example a poppet or spool element, that is solenoid actuated and configured to move to any position between a first end-position at which fluid is allowed to flow from second chamber 40, and a second end-position at which fluid is blocked from flowing from second chamber 40. It is contemplated that rod-end drain valve 94 may include additional or different valve element such as, for example, a fixed-position valve element or any other valve elements known in the art. It is also contemplated that rod-end drain valve 94 may alternatively be hydraulically actuated, mechanically actuated, pneumatically actuated, or actuated in another suitable manner.

Pump 52 may have variable displacement and be load-sense controlled to draw fluid from tank 53 and discharge the fluid at a specified elevated pressure to valve arrangements 54, 56. That is, pump 52 may include a stroke-adjusting mechanism 96, for example a swashplate or spill valve, a position of which is hydro-mechanically adjusted based on a sensed load of hydraulic control system 48 to thereby vary an output (e.g., a discharge rate) of pump 52. The displacement of pump 52 may be adjusted from a zero displacement position at which substantially no fluid is discharged from pump 52, to a maximum displacement position at which fluid is discharged from pump 52 at a maximum rate. In one embodiment, a load-sense passage (not shown) may direct a pressure signal to stroke-adjusting mechanism 96 and, based on a value of that signal (i.e., based on a pressure of signal fluid within the passage), the position of stroke-adjusting mechanism 96 may change to either increase or decrease the output of pump 52 and thereby maintain the specified pressure. Pump 52 may be drivably connected to prime mover 16 of machine 10 by, for example, a countershaft, a belt, or in another suitable manner. Alternatively, pump 52 may be indirectly connected to prime mover 16 via a torque converter, a gear box, an electrical circuit, or in any other manner known in the art.

Pump 52 may have a maximum flow rate capacity that is dependent, at least in part, on an input speed and a displacement position of stroke-adjusting mechanism 96. That is, for a given input speed (i.e., output speed of prime mover 16) and a given displacement, pump 52 may discharge a particular amount of pressurized fluid within a specified period of time. This amount of fluid may be the maximum amount of fluid that can be consumed by hydraulic cylinders 20, 26 without making a change to the displacement or input speed of pump 52. In order to increase the flow rate capacity of pump 52 for a given input speed, the displacement of pump 52 may need to be increased, up to a maximum displacement position. Similarly, in order to increase the flow rate capacity of pump 52 for a given displacement, the input speed of pump 52 may need to be increased. In most situations, however, the input speed of pump 52 (i.e., the output speed of prime mover 16) may be controlled based on factors not associated with pump 52, for example target engine speeds associated with machine efficiency and/or travel speeds of machine 10. Accordingly, the primary means of controlling the flow rate of pump 52 may include adjusting the displacement thereof up to the maximum displacement position, at which additional flow may be unavailable.

Tank 53 may constitute a reservoir configured to hold a supply of fluid. The fluid may include, for example, a dedicated hydraulic oil, an engine lubrication oil, a transmission lubrication oil, or any other fluid known in the art. One or more hydraulic circuits within machine 10 may draw fluid from and return fluid to tank 53. It is also contemplated that hydraulic control system 48 may be connected to multiple separate fluid tanks, if desired.

Controller 58 may embody a single microprocessor or multiple microprocessors that include components for controlling valve arrangements 54, 56 based on, among other things, input from an operator of machine 10, the torque limit from prime mover 16, the maximum flow capacity of pump 52, and/or one or more sensed operational parameters. Numerous commercially available microprocessors can be configured to perform the functions of controller 58. It should be appreciated that controller 58 could readily be embodied in a general machine microprocessor capable of controlling numerous machine functions. Controller 58 may include a memory, a secondary storage device, a processor, and any other components for running an application. Various other circuits may be associated with controller 58 such as power supply circuitry, signal conditioning circuitry, solenoid driver circuitry, and other types of circuitry.

Controller 58 may receive operator input associated with a desired movement of machine 10 by way of one or more interface devices 98 that are located within an operator station of machine 10. Interface devices 98 may embody, for example, single or multi-axis joysticks, levers, or other known interface devices located proximate an onboard operator seat (if machine 10 is directly controlled by an onboard operator) or located within a remote station offboard machine 10. Each interface device 98 may be a proportional-type device that is movable through a range from a neutral position to a maximum displaced position to generate a corresponding displacement signal that is indicative of a desired velocity of work tool 14 caused by hydraulic cylinders 20, 26, for example a desired lifting and/or tilting velocity of work tool 14. The desired lifting and tilting velocity signals may be generated independently or simultaneously by the same or different interface devices 98, and be directed to controller 58 for further processing.

One or more maps relating the interface device position signals, the prime mover torque limit, maximum pump flow capacity, the corresponding desired work tool velocities, associated flow rates, valve element positions, system pressures, and/or other characteristics of hydraulic control system 48 may be stored in the memory of controller 58. Each of these maps may be in the form of tables, graphs, and/or equations. In one example, desired work tool velocity and commanded flow rates may form the coordinate axis of a 2-D table for control of head- and rod-end supply valves 80, 82, 88, 90. The commanded flow rates required to move hydraulic cylinders 20, 26 at the desired velocities and corresponding valve element positions of the appropriate valve arrangements 54, 56 may be related in the same or another separate 2- or 3-D map, as desired. It is also contemplated that desired velocity may alternatively be directly related to the valve element position in a single 2-D map. Controller 58 may be configured to allow the operator to directly modify these maps and/or to select specific maps from available relationship maps stored in the memory of controller 58 to affect actuation of hydraulic cylinders 20, 26. It is also contemplated that the maps may be automatically selected for use by controller 58 based on sensed or determined modes of machine operation, if desired.

Controller 58 may be configured to receive input from interface device 98 and to command operation of valve arrangements 54, 56 in response to the input and based on the relationship maps described above. Specifically, controller 58 may receive the interface device position signal indicative of a desired work tool velocity, and reference the selected and/or modified relationship maps stored in the memory of controller 58 to determine desired flow rates for the appropriate supply and/or drain elements within valve arrangements 54, 56. In conventional hydraulic systems, the desired flow rates would then be commanded of the appropriate supply and drain elements to cause filling of particular chambers within hydraulic cylinders 20, 26 at rates that correspond with the desired work tool velocities. However, as described above, there may be situations where the desired flow rates, together, could result in torque consumption by pump 52 that exceeds the torque limit provided by prime mover 16, thereby increasing the likelihood of speed droop, low efficiency, and even prime mover malfunctions. Accordingly, controller 58, as will be described in more detail in the following section, may be configured to selectively reduce the desired flow rates before commanding valve arrangements 54, 56 to meter pressurized fluid into hydraulic cylinders 20, 26, thereby limiting the torque consumption by pump 52.

Controller 58 may rely, at least in part, on measured flow rates and/or pressures of fluid entering each hydraulic cylinder 20, 26 to account for machine-to-machine variability. The measured flow rates may be directly or indirectly sensed by one or more sensors 102, 103. In the disclosed embodiment, each of sensors 102, 103 may embody a magnetic pickup-type sensor associated with a magnet (not shown) embedded within the piston assembly 36 of different hydraulic cylinders 20, 26. In this configuration, sensors 102, 103 may each be configured to detect an extension position of the corresponding hydraulic cylinder 20, 26 by monitoring the relative location of the magnet, indexing position changes to time, and generating corresponding velocity signals. As hydraulic cylinders 20, 26 extend and retract, sensors 102, 103 may generate and direct the velocity signals to controller 58 for further processing. It is contemplated that sensors 102, 103 may alternatively embody other types of sensors such as, for example, magnetostrictive-type sensors associated with a wave guide (not shown) internal to hydraulic cylinders 20, 26, cable type sensors associated with cables (not shown) externally mounted to hydraulic cylinders 20, 26, internally- or externally-mounted optical sensors, rotary style sensors associated with a joint pivotable by hydraulic cylinders 20, 26, or any other type of sensors known in the art. It is further contemplated that sensors 102, 103 may alternatively only be configured to generate signals associated with the extension and retraction positions of hydraulic cylinders 20, 26, with controller 58 then indexing the position signals according to time and thereby determining the velocities of hydraulic cylinders 20, 26 based on the position signals from sensors 102, 103. From the velocity information provided by sensors 102, 103 and based on known geometry and/or kinematics of hydraulic cylinders 20, 26 (e.g., flow areas), controller 58 may be configured to calculate the flow rates of fluid entering hydraulic cylinders 20, 26. That is, the flow rate of fluid entering a particular cylinder may be calculated by controller 58 as a function of that cylinder's velocity and its cross-sectional flow area.

The pressure of hydraulic control system 48 may be directly or indirectly measured by way of a pressure sensor 105. Pressure sensor 105 may embody any type of sensor configured to generate a signal indicative of a pressure of hydraulic control system 48. For example, pressure sensor 105 may be a strain gauge-type, capacitance-type, or piezo-type compression sensor configured to generate a signal proportional to a compression of an associated sensor element by fluid in communication with the sensor element. Signals generated by pressure sensor 105 may be directed to controller 58 for further processing.

Figure 3:
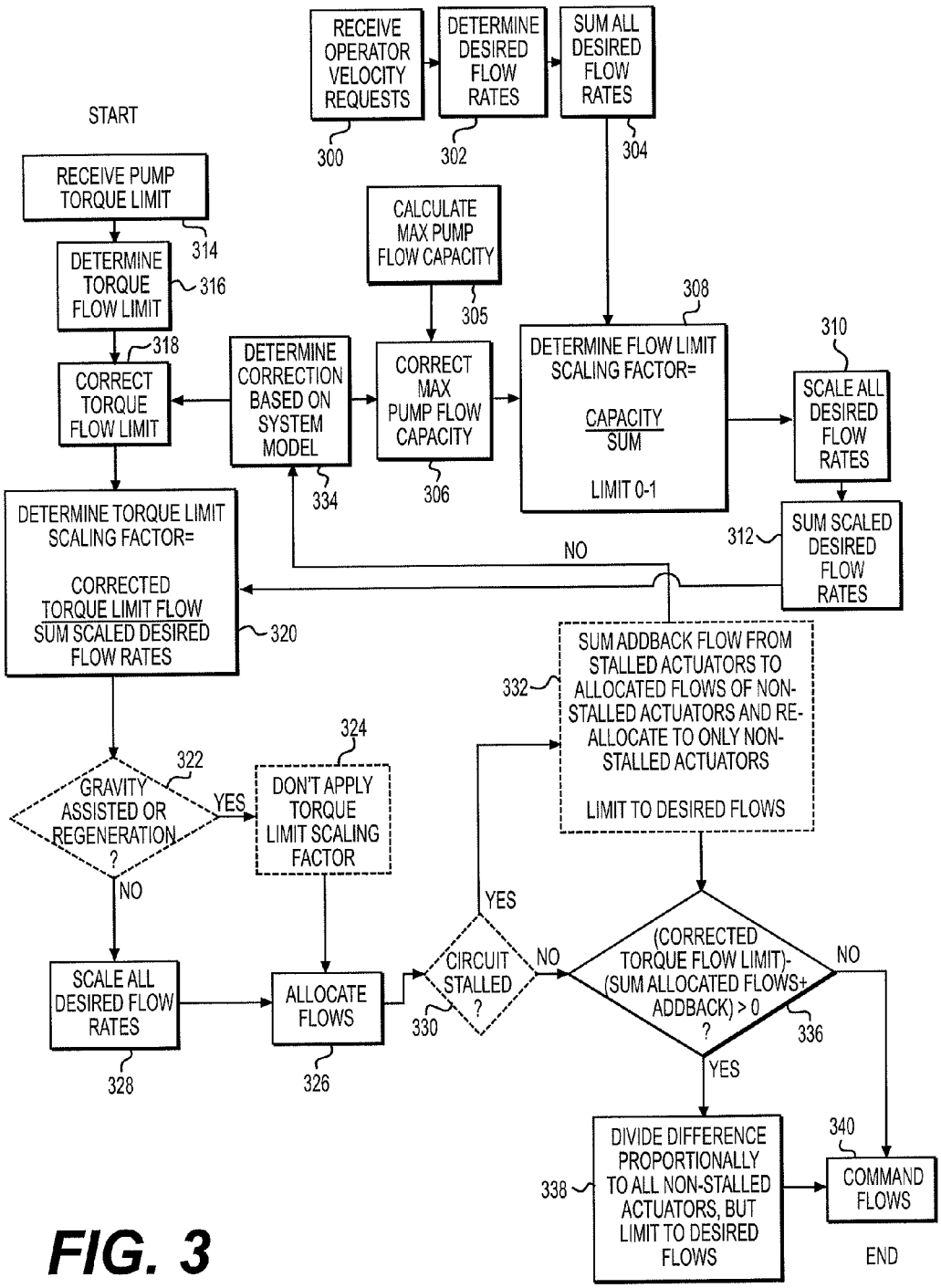
FIG. 3 is a flow chart illustrating an exemplary disclosed method performed by the hydraulic control system of FIG. 2.

FIG. 3 illustrates an exemplary pump torque limiting operation performed by controller 58. FIG. 3 will be discussed in more detail in the following section to further illustrate the disclosed concepts.

Industrial Applicability

The disclosed hydraulic control system may be applicable to any machine that includes multiple fluid actuators where machine performance and actuator controllability are issues. The disclosed hydraulic control system may enhance machine performance by reducing the likelihood and/or effects of prime mover stall through pump torque limiting operations. Actuator controllability may be improved by implementing the pump torque limiting operations in a distributed and proportional manner relative to fluid flow through each of the actuators, and by accounting for pump capacity, actuator stall, flow correction, and gravity assistance. Operation of hydraulic control system 48 will now be explained.

During operation of machine 10, a machine operator may manipulate interface device 98 to request corresponding movements of work tool 14. The displacement positions of interface device 98 may be related to operator desired velocities of work tool 14. Interface device 98 may generate position signals indicative of the operator desired velocities of work tool 14 during manipulation, and direct these position signals to controller 58 for further processing.

Controller 58 may receive the operator interface device position signals that are indicative of desired velocities (Step 300), and reference the maps stored in memory to determine the corresponding desired flow rates (Step 302) that should cause hydraulic cylinders 20, 26 to move at the desired velocities. Controller 58 may then sum all of the desired flow rates for each of hydraulic cylinders 20, 26 (Step 304).

At about the same time as completing Steps 300-304, controller 58 may also determine a maximum pump flow rate capacity (Step 305) given current operating conditions. Controller 58 may determine the maximum pump flow rate capacity by referencing a current pump input speed (i.e., a current output speed of prime mover 16) with a relationship stored in memory to determine a maximum displacement position available for pump 52 at the given speed. Controller may then calculate the corresponding flow rate as a function of the input speed and the maximum displacement position, and in some embodiments, offset the flow rate based on known losses, overspeed set points, and/or uncontrolled non-actuator loads that are consuming flow from pump 52. In some embodiments, controller 58 may also apply a correction factor to the maximum flow capacity of pump 52 that accounts for pump-to-pump variations (Step 306). Determination of the correction factor will be described in more detail below.

Controller 58 may utilize the maximum pump flow capacity and the sum of the desired flow rates described above to determine a flow limit scaling factor (Step 308) that may help to ensure that the desired flows do not exceed the maximum capacity of pump 52. In particular, the flow limit scaling factor may be determined as a ratio of the maximum pump flow capacity and the sum of the desired flow rates. In the disclosed embodiment, this ratio may be limited to a range of 0-1. After determination of the flow limit scaling factor, controller 58 may apply the factor during a first reduction of the desired flow rates. That is, controller 58 may multiply the flow limit scaling factor to the desired flow rate for each of hydraulic cylinders 20, 26 (Step 310). Controller 58 may then sum the desired flow rates after the first reduction has occurred (Step 312).

At about the same time as completing Steps 300-312, controller 58 may also receive a torque limit for pump 52 from prime mover 16 (Step 314), and determine a corresponding torque flow limit (Step 316). The torque flow limit may be determined as a function of a current pressure signal, provided by pressure sensor 105, and the torque limit provided by prime mover 16. For example, the torque limit may be divided by the current pressure to determine a current torque flow limit. In a manner similar to that described above with respect to Step 306, the torque flow limit determined in Step 316 may be corrected using the same or another correction factor that accounts for pump-to-pump variations (Step 318). As also described above, determination of the correction factor will be explained in more detail below.

Controller 58 may utilize the corrected torque flow limit determined in Steps 316, 318 and the sum of the scaled desired flow rates determined in Step 312 to determine a torque limit scaling factor that may help to ensure that the desired flow rates do not exceed the torque limit set by prime mover 16. In particular, the torque limit scaling factor may be determined as a ratio of the corrected torque limit flow and the sum of the scaled desired flow rates. After determination of the torque limit scaling factor, controller 58 may apply the factor during a second reduction of the desired flow rates (Step 328), and then allocate the resulting flow rates to the corresponding valve arrangements 54, 56 (Step 326).

In some situations, controller 58 may be configured to consider the movement direction requested by the operator in Step 300 during allocation of the scaled desired flow rates. Specifically, controller 58 may be configured to determine if the requested movement of work tool 14 is in general alignment with the force of gravity (i.e., when the requested flow direction causes the corresponding hydraulic cylinder 20, 26 to move with the assistance of or against the force of gravity) or when regeneration one of hydraulic cylinders 20, 26 is occurring (Step 322), and respond differently according to the determination. When the requested movement is against the force of gravity (e.g., when work tool 14 is lifting or tilting upward) and regeneration is not occurring, control may proceed through step 322, as described above. However, when the requested movement is in alignment with the force of gravity (e.g., when work tool 14 is lowering or tilting downward) or when regeneration is occurring, controller 58 may be configured to maintain without change the scaled desired flow rates determined during Step 310 (Step 324) (i.e., the torque limit scaling ratio may not be applied). In this manner, the effects of gravity or regeneration causing a cylinder to move faster than possible with the commanded flow rate of fluid may be avoided and the integrity of the correction flow rate preserved, thereby providing stability to hydraulic control system 48.

Controller 58 also be configured to determine, in some embodiments, if a subset of the actuators within hydraulic control system 48 (i.e., if one or more of hydraulic cylinders 20, 26) is experiencing a stall condition (Step 330), and respond accordingly. In the disclosed embodiment, controller 58 may determine that a subset of the actuators of hydraulic control system 48 is experiencing the stall condition based on, among other things, the signals from velocity sensors 102, 103 and from pressure sensor 105. For example, when a velocity of one of hydraulic cylinders 20, 26, as determined by velocity sensor 102 or 103, is significantly slower than expected (e.g., nearly or completely stopped), the pressure of hydraulic control system is high (e.g., greater than about 90% of a maximum system pressure), as determined by pressure sensor 105, and the desired flow rate for the corresponding cylinder is greater than a minimum threshold level, controller 58 may consider the cylinder to have stalled. It is contemplated that other methods of detecting stall may additionally or alternatively be utilized, as desired.

When controller 58 determines that a subset of actuators is experiencing the stall condition, controller 58 may conclude that the actual flow rate of pressurized fluid into that actuator is near or at zero. In this situation, the flow rate of fluid previously allocated in Step 326 for the stalled subset of actuators could be utilized by the other non-stalled actuators. Accordingly, controller 58 may sum the fluid flow rates originally allocated for the stalled actuators (now termed as addback flow), add this sum to a sum of the allocated flows rates originally intended for the non-stalled actuators, and reallocate the total to only the non-stalled actuators (Step 332). In some embodiments, the newly reallocated flow rates may need to be limited to the original desired flow rates determined in Step 302 described above.

The reallocated flow rates and the flow rates of the stalled subset of actuators (i.e., the low or zero flow rates) may be passed by controller 58 through a system response model to determine the correction factors utilized in Steps 306 and 318 described above (Step 334). In the disclosed embodiment, the correction factors may be valve arrangement and/or pump-specific, and utilized to increase or decrease through compounding and/or scaling the desired flow rates for each arrangement and/or the maximum flow rate capacity of pump 52. The system response model may be used to estimate how hydraulic control system 48 will respond to a particular valve arrangement command to meter a desired flow rate of fluid into a corresponding cylinder. In the disclosed embodiment, the system response model may consist of three different portions, including a pump response portion, a cylinder response portion, and a valve behavior portion. It is contemplated, however, that the system response model could include additional and/or different portions, as desired. Each portion of the system response model may include one or more equations, algorithms, maps, and/or subroutines that function to predict the physical response and/or behavior of the specified portion of hydraulic control system 48. Each of the equations, algorithms, maps, and/or subroutines may be developed during manufacture of machine 10 and periodically updated and/or uniquely tuned based on actual operating conditions of individual machines 10. The estimated output from the system response model may then be compared to actual measured conditions, for example actual velocities, pressures, flow rates, etc., and the correction factor calculated as a function of the comparison.

After completion of Step 332, controller 58 may be configured to ensure that all excess torque flow limit associated with prime mover 16 is fully consumed by pump 52 and commanded of valve arrangements 54, 46 to move hydraulic cylinders 20, 26 in the most efficient manner. In particular, controller 58 may be configured to compare the corrected torque flow limit that was determined in Step 318 to a sum of the reallocated flow rates (i.e., to the sum of the allocated flow rates plus any addback flow rates for only the non-stalled actuators) determined in Step 332, and determine if the difference is greater than zero (Step 336). When no excess torque flow limit exists (Step 336: No), then the flow rates reallocated in Step 332 may be commanded of the appropriate valve arrangements 54, 56 (Step 340). Otherwise (Step 336: Yes), any non-zero difference determined in Step 336 may be divided proportionally by controller 58 among the non-stalled actuators, as long as the increased flow rates do not exceed the originally desired flow rates (Step 338). After this re-division of the difference, the newly increased flow rates may be commanded of the appropriate valve arrangements 54, 56 (Step 340). By fully utilizing all of the torque flow limit, an efficiency of hydraulic control system 48 may be improved.

The disclosed hydraulic control system 48 may help to improve machine performance by reducing the likelihood and/or effects of prime mover stall through pump torque limiting operations. Specifically, hydraulic control system 48 may be configured to determine flow and torque limitations of pump 52 and, based on these limitations, scale operator requested flow rates in a manner that helps ensure the limitations are not exceeded. In this manner, performance of prime mover 16 may be improved, along with the overall performance of machine 10.

It will be apparent to those skilled in the art that various modifications and variations can be made to the disclosed hydraulic control system. Other embodiments will be apparent to those skilled in the art from consideration of the specification and practice of the disclosed hydraulic control system. It is intended that the specification and examples be considered as exemplary only, with a true scope being indicated by the following claims and their equivalents.

What is claimed is:

1. A hydraulic control system, comprising:
- a pump configured to pressurize fluid;
- a plurality of actuators configured to receive the pressurized fluid;
- a plurality of valve arrangements configured to meter pressurized fluid from the pump into the plurality of actuators;
- at least one operator input device configured to generate signals indicative of desired velocities of the plurality of actuators; and
- a controller in communication with the plurality of valves and the at least one operator input device, the controller being configured to:
  - receive a pump torque limit;
  - determine a maximum pump flow capacity;
  - determine desired flow rates for each of the plurality of valve arrangements based on the signals from the at least one operator input device;
  - make a first reduction of the desired flow rates based on the maximum pump flow capacity;
  - make a second reduction of the desired flow rates based on the pump torque limit; and
  - command the plurality of valve arrangements to meter the desired flow rates after the second reduction.

2. The hydraulic control system of claim 1, wherein the maximum pump flow capacity is determined based on a pump displacement and a pump speed.

3. The hydraulic control system of claim 1, wherein the first reduction is based on a ratio of the maximum pump flow capacity and a sum of the desired flow rates.

4. The hydraulic control system of claim 1, wherein:
- the controller is further configured to determine a pump limit flow rate based on the pump torque limit, and to correct the pump limit flow rate based on a model of pump response delay; and
- the second reduction is based on the pump limit flow rate after correction.

5. The hydraulic control system of claim 4, wherein the second reduction is based on a ratio of the pump limit flow rate after correction to a sum of the desired flow rates after the first reduction.

6. The hydraulic control system of claim 4, wherein the controller is further configured to:
- make a determination that a subset of the plurality of actuators is experiencing a stall condition; and
- reallocate the desired flow rates of fluid for the subset to the remaining ones of the plurality of actuators based on the determination.

7. The hydraulic control system of claim 6, wherein the controller is configured to make the determination based on a velocity and a pressure of the subset.

8. The hydraulic control system of claim 6, wherein the controller is further configured to limit the reallocated desired flow rates of fluid to the desired flow rates after the first reduction and before the second reduction.

9. The hydraulic control system of claim 6, wherein the controller is further configured to:
- calculate a difference between the pump limit flow rate after correction and the reallocated desired flow rates; and
- divide the difference proportionally to all non-stalled ones of the plurality of actuators.

10. The hydraulic control system of claim 1, wherein:
- the controller is further configured to determine if the plurality of actuators are being gravity assisted or receiving regenerated flows of pressurized fluid; and
- the controller is configured to only make the second reduction when the plurality of actuators are not being gravity assisted or receiving regenerated flows of pressurized fluid.

11. A method of operating a machine, comprising:
- pressurizing fluid;
- receiving a torque limit associated with the pressurizing;
- determining a maximum flow rate capacity associated with the pressurizing;
- receiving operator input indicative of desired velocities for a plurality of hydraulic actuators;
- determining desired flow rates of fluid for each of the plurality of hydraulic actuators based on the desired velocities;
- making a first reduction of the desired flow rates based on the maximum flow rate capacity;
- making a second reduction of the desired flow rates based on the torque limit; and
- metering the pressurized fluid into the plurality of hydraulic actuators after the second reduction.

12. The method of claim 11, wherein the maximum flow rate capacity is determined based on a pump displacement and a pump speed.

13. The method of claim 11, wherein the first reduction is based on a ratio of the maximum flow rate capacity and a sum of the desired flow rates.

14. The method of claim 11, further including:

determining a pump limit flow rate based on the torque limit; and correcting the pump limit flow rate based on a pump response model, wherein the second reduction is based on the pump limit flow rate after correction.

15. The method of claim 14, wherein the second reduction is based on a ratio of the pump limit flow rate after correction to a sum of the desired flow rates after the first reduction.

16. The method of claim 14, further including:

making a determination that a subset of the plurality of actuators is experiencing a stall condition; and reallocating the desired flow rates of fluid for the subset to the remaining ones of the plurality of actuators based on the determination.

17. The method of claim 16, further including limiting the reallocated desired flow rates of fluid to the desired flow rates after the first reduction and before the second reduction.

18. The method of claim 16, further including:

calculating a difference between the pump limit flow rate after correction and the reallocated desired flow rates; and dividing the difference proportionally to all non-stalled ones of the plurality of actuators.

19. The method of claim 11, further including determining if the plurality of actuators are being gravity assisted or receiving regenerated flows of pressurized fluid, wherein making the second reduction includes only making the second reduction when the plurality of actuators are not being gravity assisted or receiving regenerated flows of pressurized fluid.

20. A machine, comprising:

a prime mover;

a body configured to support the prime mover;

a tool;

a linkage system operatively connecting the tool to the body;

a plurality of hydraulic cylinders connected between the body and the linkage system or between the linkage system and the tool to move the tool;

a plurality of valve arrangements configured to meter pressurized fluid into the plurality of hydraulic cylinders;

at least one operator input device configured to generate signals indicative of desired velocities for the plurality of hydraulic cylinders;

a pump driven by the prime mover to pressurize fluid directed to the plurality of valve arrangements; and a controller in communication with the prime mover, the at least one operator input device, and the plurality of valve arrangements, the controller being configured to:

receive a pump torque limit from the prime mover;

determine a pump limit flow rate based on the pump torque limit;

determine a maximum pump flow capacity based on a speed and a displacement;

determine desired flow rates for each of the plurality of valve arrangements based on the signals from the at least one operator input device;

make a first reduction of the desired flow rates based on a ratio of the maximum pump flow capacity and a sum of the desired flow rates;

make a second reduction of the desired flow rates based on a ratio of the pump limit flow rate and a sum of the desired flow rates after the first reduction; and command the plurality of valve arrangements to meter the desired flow rates after the second reduction.

* * * * *